US010932986B2

(12) United States Patent
Bouch et al.

(10) Patent No.: US 10,932,986 B2
(45) Date of Patent: Mar. 2, 2021

(54) PORTABLE SELF MASSAGE TABLE AND RECOVERY DEVICE

(71) Applicants: Dustin J Bouch, Petaluma, CA (US); Eric V Bostrom, Newbury Park, CA (US)

(72) Inventors: Dustin J Bouch, Petaluma, CA (US); Eric V Bostrom, Newbury Park, CA (US)

( * ) Notice: Subject to any disclaimer, the term of this patent is extended or adjusted under 35 U.S.C. 154(b) by 359 days.

(21) Appl. No.: 15/944,624

(22) Filed: Apr. 3, 2018

(65) Prior Publication Data

US 2018/0280228 A1 Oct. 4, 2018

Related U.S. Application Data

(60) Provisional application No. 62/604,087, filed on Jun. 23, 2017, provisional application No. 62/601,824, filed on Apr. 3, 2017.

(51) Int. Cl.
*A61H 15/00* (2006.01)
*A61H 1/00* (2006.01)

(52) U.S. Cl.
CPC ..... *A61H 15/00* (2013.01); *A61H 1/005* (2013.01); *A61H 2015/005* (2013.01); *A61H 2015/0064* (2013.01); *A61H 2201/1253* (2013.01); *A61H 2201/1623* (2013.01); *A61H 2201/1664* (2013.01); *A61H 2201/1676* (2013.01); *A61H 2203/0456* (2013.01)

(58) Field of Classification Search
CPC .... A61H 1/005; A61H 15/00; A61H 15/0092; A61H 2015/0007; A61H 2015/0042; A61H 2015/005; A61H 2015/0057; A61H 2201/0142; A61H 2201/1253; A61H 2201/1261; A61H 2201/1284; A61H 2203/0456; A61H 2203/0468; A61H 2205/081
USPC ..... 601/23, 24, 84, 86, 94, 97, 98, 115, 116, 601/118, 125, 128
See application file for complete search history.

(56) References Cited

U.S. PATENT DOCUMENTS 4,190,043 A * 2/1980 Thompson ..... A61H 1/00 601/115
5,022,386 A * 6/1991 Kuniskis ..... A61H 15/0078 601/117
5,165,390 A * 11/1992 Fleetwood ..... A61H 1/00 601/116
6,146,343 A * 11/2000 Stewart ..... A61H 15/00 601/118
6,190,338 B1 * 2/2001 Arndt ..... A61H 1/00 601/102
6,196,983 B1 * 3/2001 Wu ..... A61H 15/0078 601/102

(Continued)

*Primary Examiner* — Justine R Yu
*Assistant Examiner* — Benjamin M. Kusiak
(74) *Attorney, Agent, or Firm* — Dobbin IP Law P.C.; Geoffrey E. Dobbin

(57) ABSTRACT

A portable massage table and recovery device features a support table and independent massage head mounted within a slot in said support table. Both massage head and support table are supported upon the ground and the support table is capable of independent rolling motion in-line with the massage head. The massage head has varying levels of resistance and an articulable massage structure. Side rolling wheels may be used to maintain the in-line relationship of the massage head and support table.

10 Claims, 13 Drawing Sheets

(56) References Cited

U.S. PATENT DOCUMENTS

| | | | | |
|---|---|---|---|---|
| 6,224,563 | B1 * | 5/2001 | Nonoue | A61H 15/0078 601/99 |
| 6,808,500 | B1 * | 10/2004 | Cheng-Yi | A61H 15/0078 601/102 |
| 6,840,914 | B1 * | 1/2005 | Takamura | A61H 15/0078 601/102 |
| 7,014,620 | B2 * | 3/2006 | Kim | A61H 15/0078 601/101 |
| 7,037,279 | B2 * | 5/2006 | Kim | A61N 5/0625 601/103 |
| 7,081,098 | B2 * | 7/2006 | Kim | A61H 7/004 601/103 |
| 7,081,100 | B2 * | 7/2006 | Kim | A61H 15/0078 601/103 |
| 7,118,541 | B2 * | 10/2006 | Kim | A61H 1/00 601/15 |
| 9,730,856 | B2 * | 8/2017 | Tamaki | A61H 7/007 |
| 9,999,564 | B2 * | 6/2018 | Ishiguro | A61H 15/00 |
| 10,588,683 | B2 * | 3/2020 | Lee | A61B 5/6892 |
| 10,610,443 | B2 * | 4/2020 | Lee | A61H 15/02 |
| 2003/0018284 | A1 * | 1/2003 | Lim | A61H 15/00 601/98 |
| 2008/0177212 | A1 * | 7/2008 | Kim | A61H 15/00 602/33 |
| 2014/0221886 | A1 * | 8/2014 | Chen | A61H 23/006 601/108 |
| 2018/0116902 | A1 * | 5/2018 | Patton | A61H 15/00 |

* cited by examiner

PORTABLE SELF MASSAGE TABLE AND RECOVERY DEVICE

CROSS-REFERENCES TO RELATED APPLICATIONS

The present Application claims priority as a non-provisional perfection of prior filed U.S. Applications 62/601,824, filed Apr. 3, 2017, and 62/604,087, filed Jun. 23, 2017, and incorporates the same by reference in their entirety herein.

FIELD OF THE INVENTION

The present invention relates to the field of massage therapy and more particularly relates to a user actuated self-massage table and apparatus.

BACKGROUND OF THE INVENTION

Massage is an ancient art. Since time immemorable, people have found that the rubbing and stimulation of muscles in the limbs, back, torso, and anywhere in the body had a therapeutic effect in a variety of ways, such as: working out lactic acid and other toxins built up in the muscles; injury and ailment rehabilitation; pain relief; headache and muscle tension relief; the breaking up of scar tissue; increasing mobility and flexibility; and, the stimulation of circulatory system for a variety of health purposes. As such, the massage industry is seen as providing a valuable service to society and various tools have been developed for massage, be it to be used on another individual or to be used on one's self. Massage tools made for one's self are of great importance as a masseuse may not be available to an individual due to availability or affordability and certain parts of the body are notoriously hard to reach by one's self. However, self-massage tools tend to have at least one of many drawbacks. First, because self-massage tools are usually made for hard to reach areas they tend to be cumbersome and difficult to maneuver into those areas while maintaining requisite control. Second, because self-massage inherently involves massage of one's self certain muscle groups controlling the tool will always be in a flexed and active condition and not the flaccid condition needed for optimum massage.

The present invention is a versatile self-massage apparatus that is designed to utilize an individual's body weight to apply pressure for self-massage and has the versatility to also aid as a total body recovery and strengthen apparatus that can be powered by the user while lying, sitting, kneeling, etc. on the table surface for improved massage, recovery and strengthening benefits such as working out lactic acid and other toxins built up in the muscles; injury and ailment rehabilitation; pain relief; headache and muscle tension relief; the breaking up of scar tissue; increasing mobility and flexibility; stimulation of circulatory system, etc. The massage table apparatus is placed on the floor where the user then glides on a table that rolls on wheels, while maintaining contact with a stationary massage head. With the user lying on the table surface, the user can then glide back and forth on the table, contacting the massage head or foam roller in their desired area for self-massage while their muscles remain flaccid. The massage head apparatus has spherical wheels and pivots on a central fulcrum so it can adjust variably in height to the contours of the spine or other body parts; The massage head can be changed out to accommodate various attachments for different massage purposes and/or myofascial release and circulatory stimulation. The table surface and/or the massage head is adjustable in height and or spring tension to apply more or less massage pressure as desired by the user.

The present invention represents a departure from the prior art in that the self-massage table of the present invention allows for individual use and support of the body while maintaining a flaccid condition of targeted muscle groups.

SUMMARY OF THE INVENTION

In view of the foregoing disadvantages inherent in the known types of massage tools, an improved massage table may provide a self-massage apparatus that meets the following objectives: that it be portable and easy to use, that it supports a user's body to keep muscles flaccid when working on them, that it be easily adaptable to user needs. As such, a new and improved massage table may comprise a table body and a separately supported massage head in order to accomplish these objectives.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, a preferred embodiment of the portable self-massage table and recovery device is herein described. It should be noted that the articles "a", "an", and "the", as used in this specification, include plural referents unless the content clearly dictates otherwise.

Figure 19:
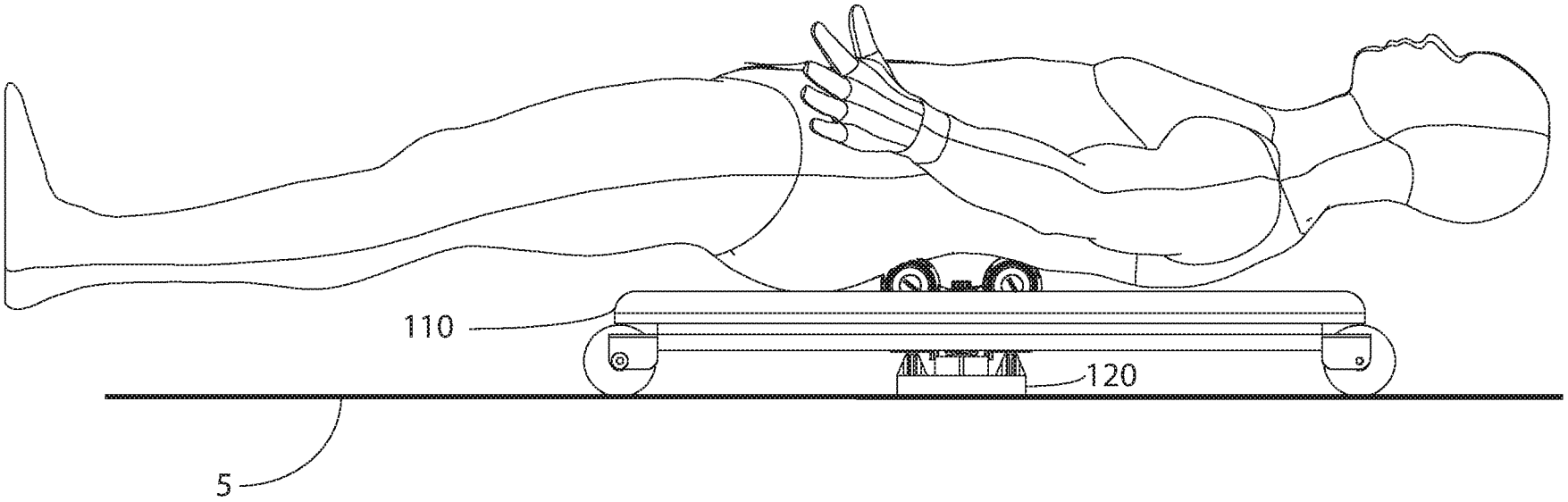
FIG. 19 is a side elevation of the massage table and massage head of FIG. 1, in use.

With reference to FIGS. 1-6, the self-massage table and recovery device 10 is comprised of two basic components: the support table 110 and the massage head 120. These components are not rigidly connected to each other. The support table 110 features a support surface 112, which may or may not be padded (FIG. 5), and a plurality of casters 114, or other means of rolling motion, on which the support table 110 may roll upon a surface 5 (FIG. 19). A central slot 118 resides in the support table 112 through which massage head 120 may protrude. When in use, the massage head 120 will retain its relative in-line position within the slot 118 by the interaction of a plurality of side wheels 126 and an inner wall 116 of the support table 110.

The preferred massage head 120 independently sits on the support surface 5 (FIG. 19) and has many component parts (FIGS. 5-11). The ideal form of the massage head rest upon an I-shaped base 122 with a central housing 128. At each corner of the I, are pedestals 124 which support side wheels 126. The housing supports a central pin 130 which extends therethrough and upward and is stabilized by a grommet 132. The central pin 130 supports a carriage 136 with a plurality of downward prongs and a carapace 140 over the same. The carapace 140 should also have two downward prongs 142 and spring should surround the central pin 130 (center spring 134) and the carriage's prongs (138*a*, 138*b*). Two lateral slots in the housing 128 should accommodate the carapace's downward prongs 142. Holes bored in the housing also accommodate the carriage's downward prongs, and springs 138*a*, 138*b* as selected in the manner described below. In this manner, the entire carapace 142 and carriage 136 may ride up and down the center pin 130.

The carapace 142 presents a fulcrum 144 for the roller balls 154 which form the active part of the massage head 120. The fulcrum 144 may be a simple box on top of the carapace 140. Rockers 146, each supporting two roller balls 154, may be mounted to the fulcrum 144 by rocker pins 149 and spring biased by torsion springs 148 likewise secured by the rocker pins 149. Spring arms 147 in the rockers 146 cause compression of the torsion springs 148 which provides the bias. Roller balls 154 are then mounted upon an axle 152 which passes through provided holes on the two rockers 146. A selector knob 150 is mounted at the top of the fulcrum 144 on the center pin 130. This allows the carriage 136 to turn within the carapace 140 and select different spring resistances for the massage head 120.

Figure 1:
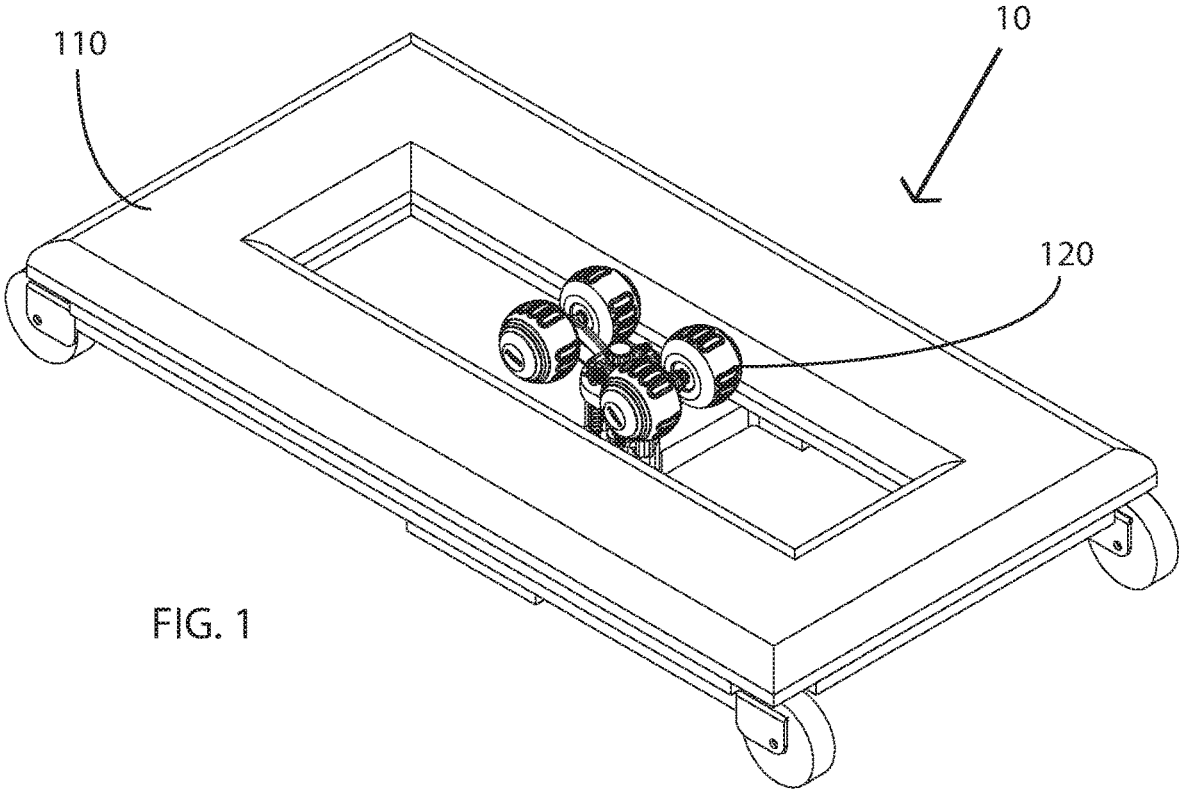
FIG. 1 is a perspective view of a massage table and separate massage head.
Figure 2:
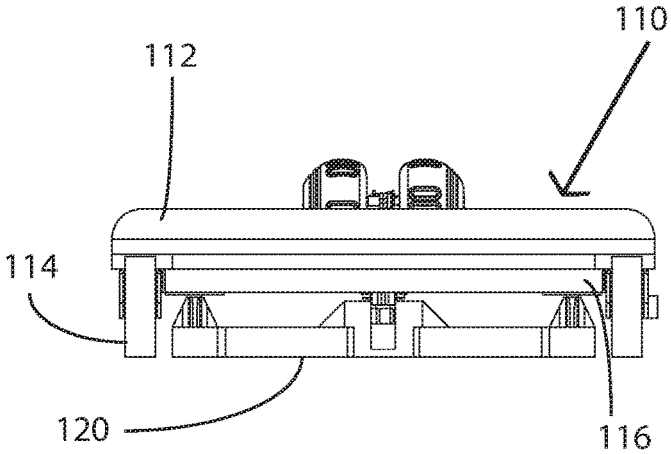
FIG. 2 is a front elevation of the massage table and massage head of FIG. 1.
Figure 3:
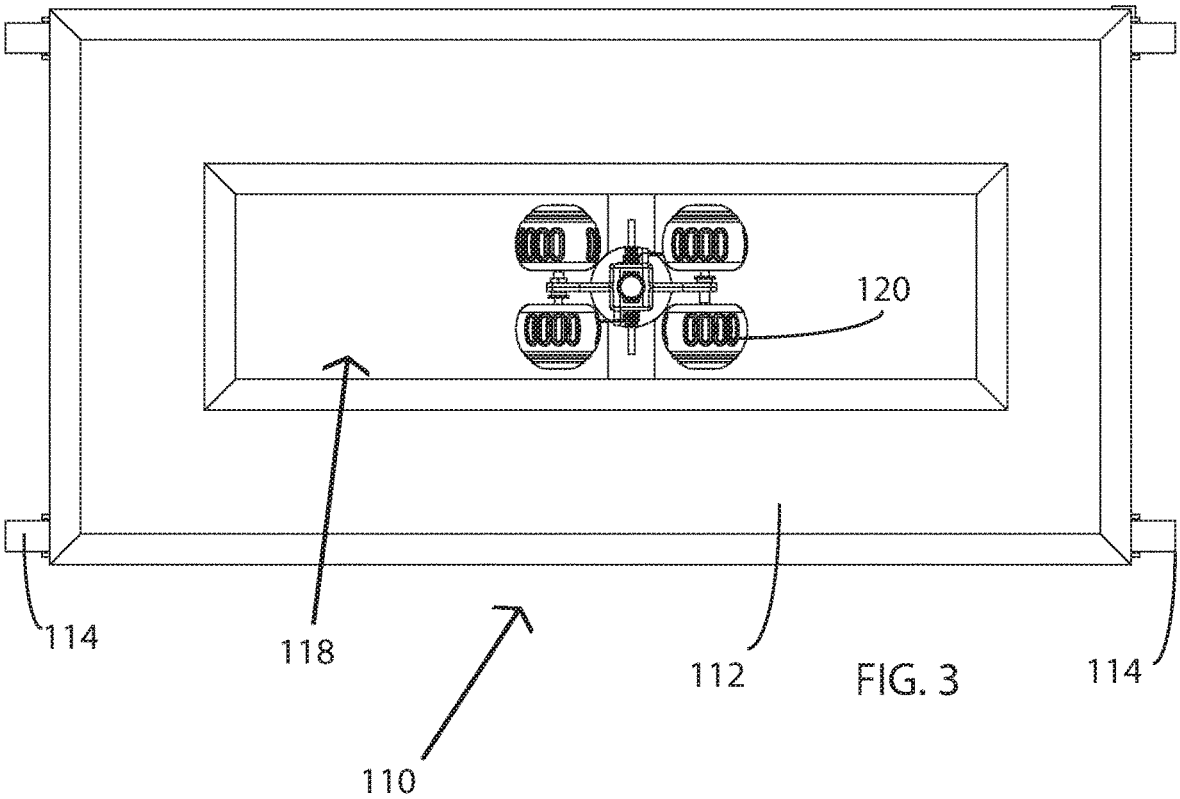
FIG. 3 is a top plan view of the massage table and massage head of FIG. 1.
Figure 4:
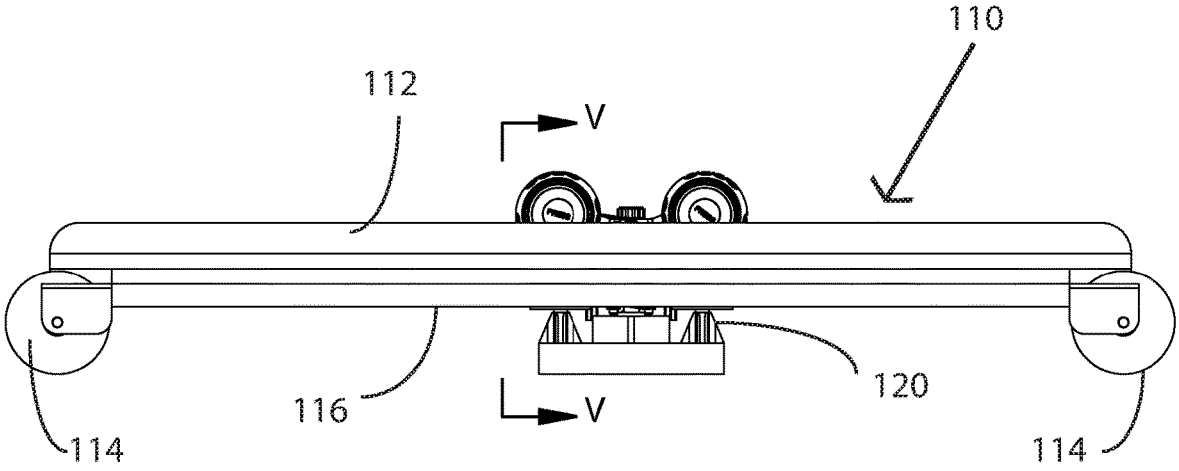
FIG. 4 is a side elevation of the massage table and massage head of FIG. 1.
Figure 5:
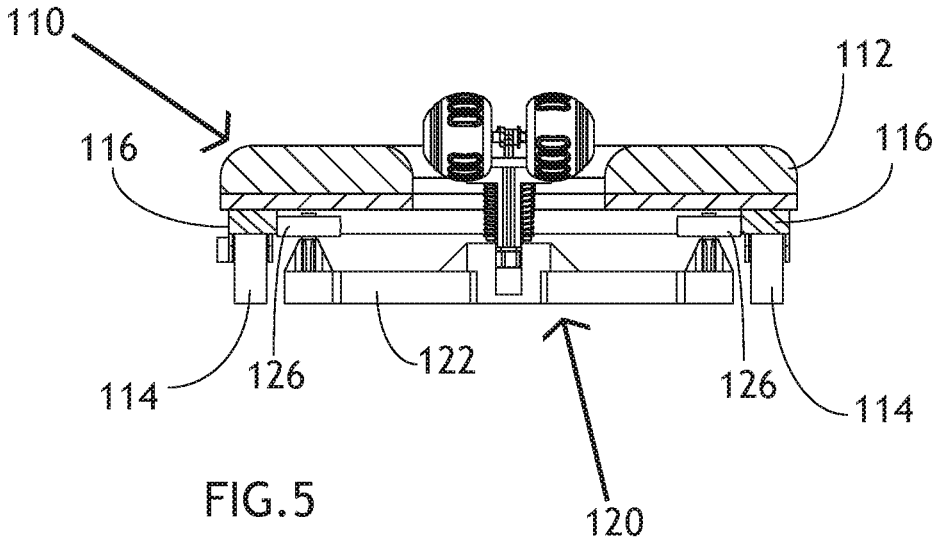
FIG. 5 is a sectional view of the massage table and massage head of FIG. 4, taken along line V-V.
Figure 6:
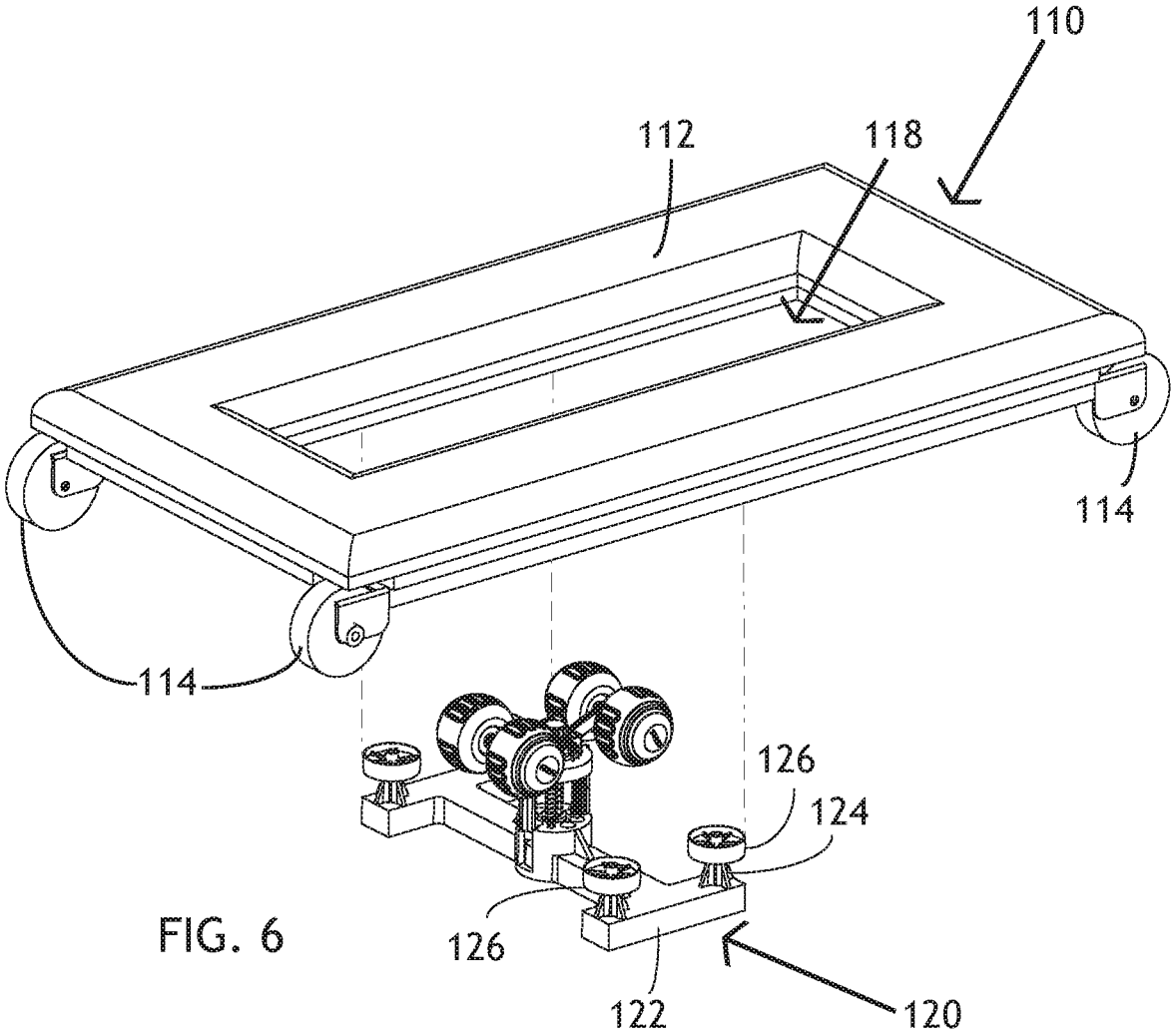
FIG. 6 is an exploded view of the massage table and massage head of FIG. 1.
Figure 7:
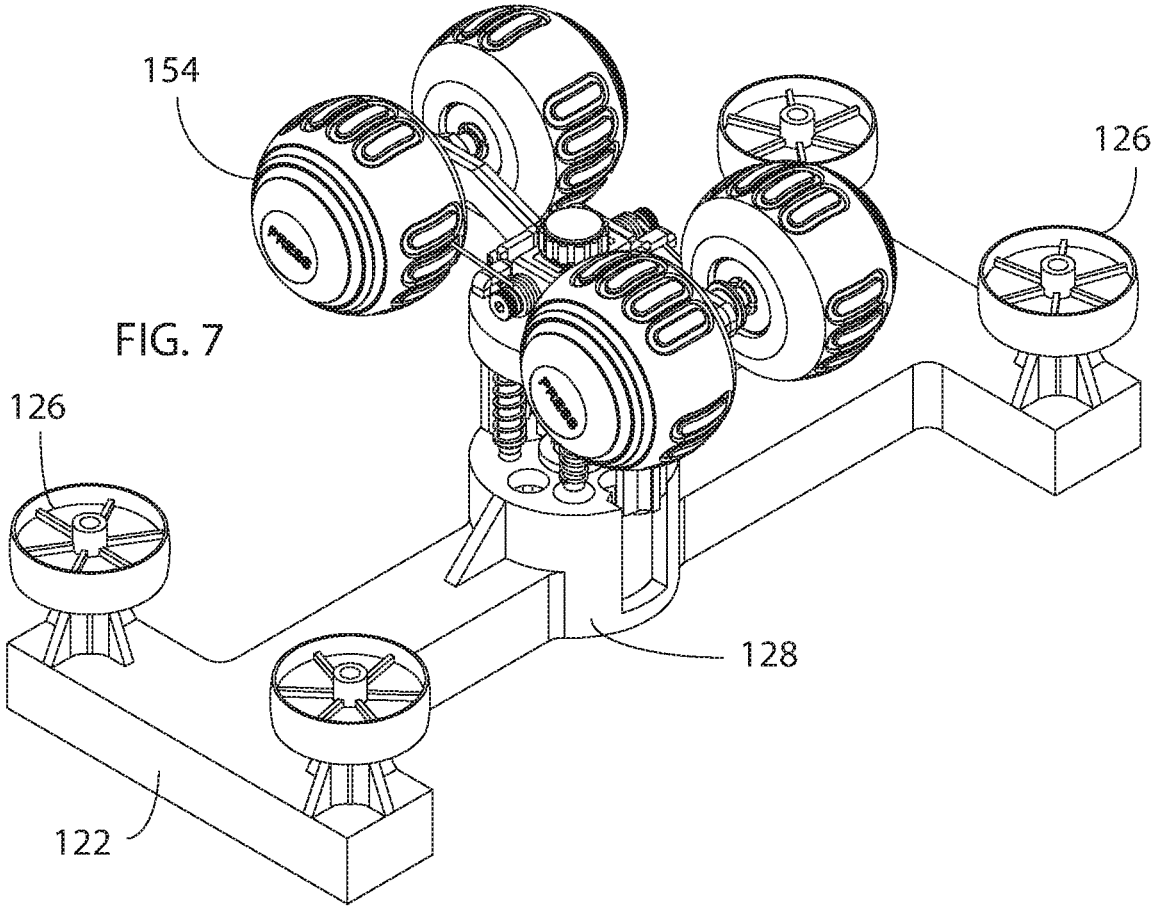
FIG. 7 is a perspective view of the massage head of FIG. 1.
Figure 8:
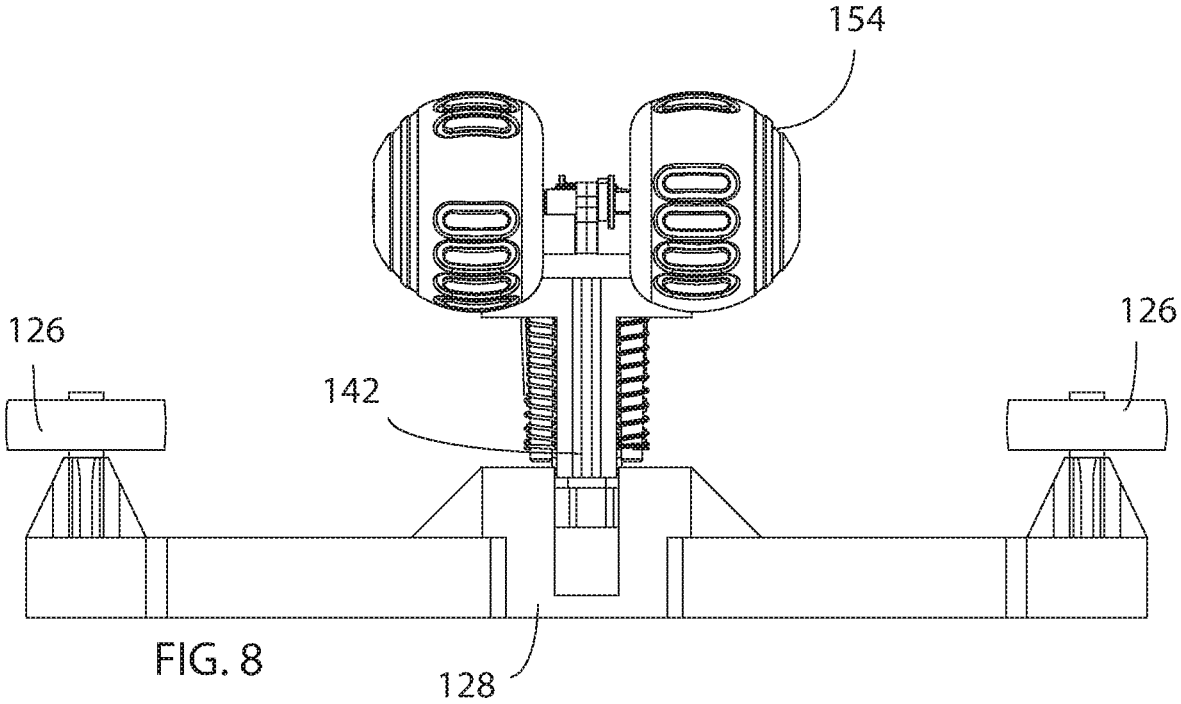
FIG. 8 is a front elevation of the massage head of FIG. 7.
Figure 9:
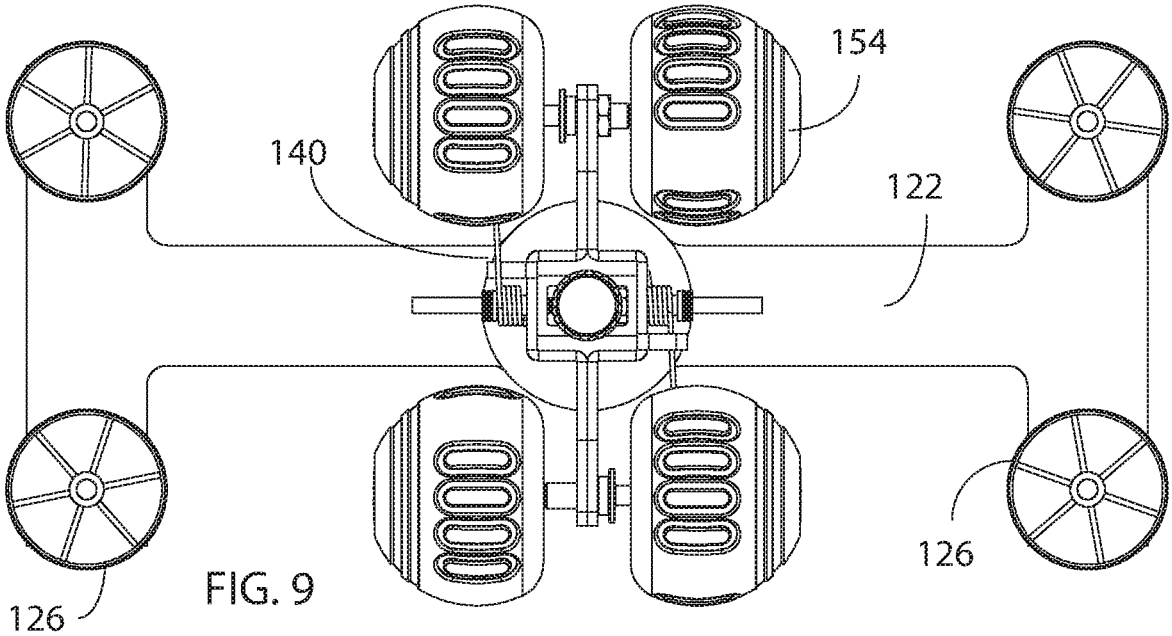
FIG. 9 is a top plan view of the massage head of FIG. 7.
Figure 10:
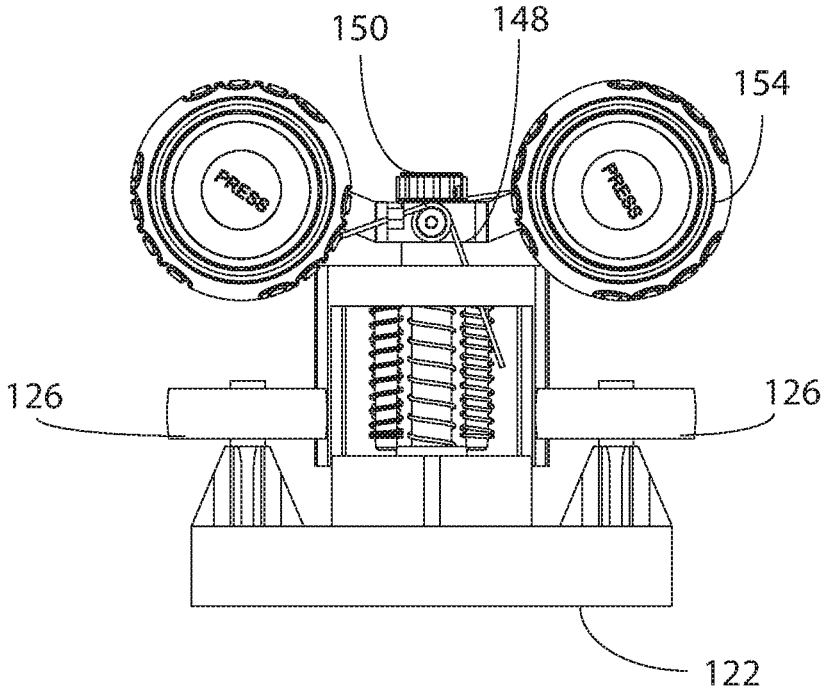
FIG. 10 is a side elevation of the massage head of FIG. 7.
Figure 11:
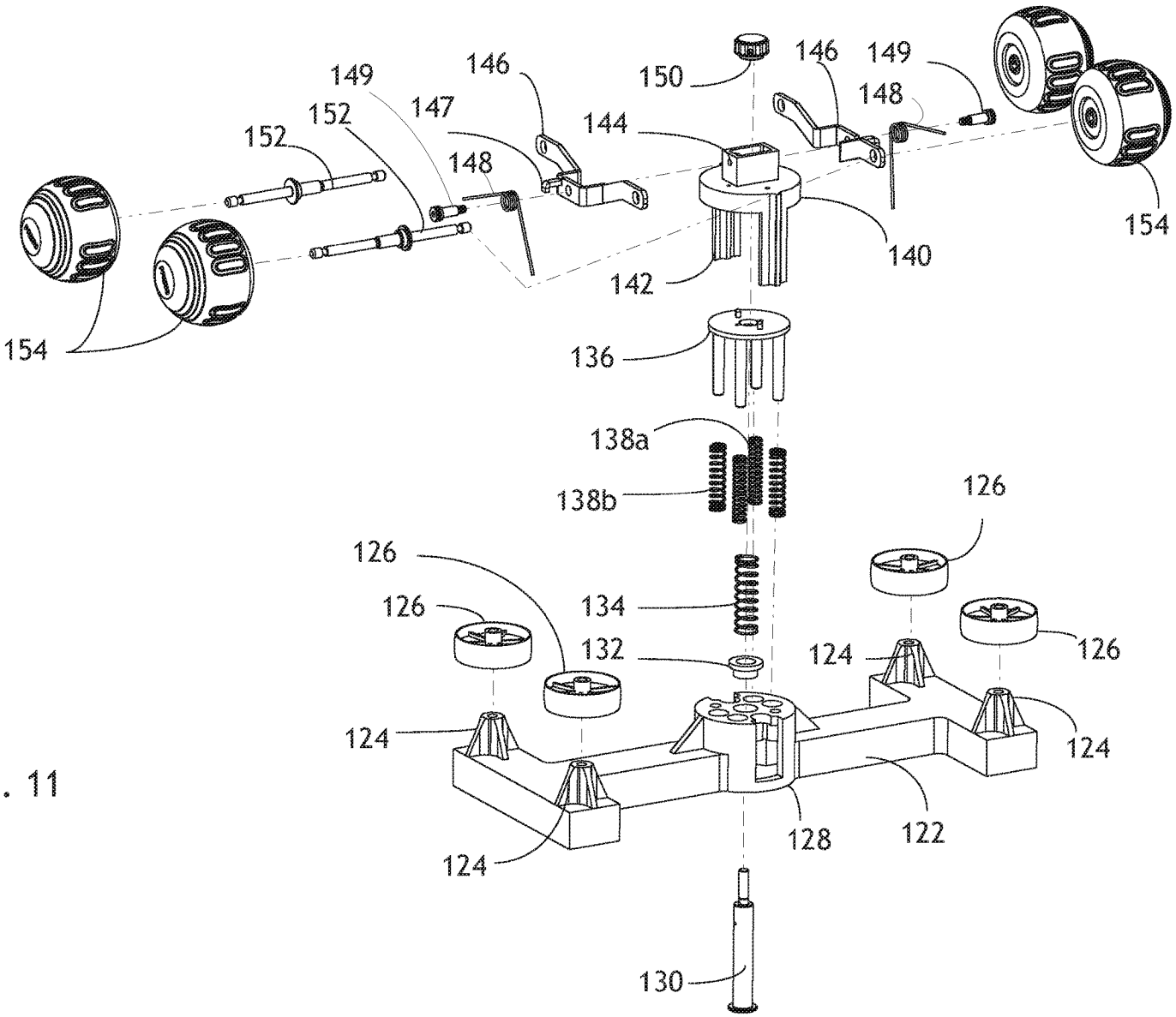
FIG. 11 is an exploded view of the massage head of FIG. 7.
Figure 12:
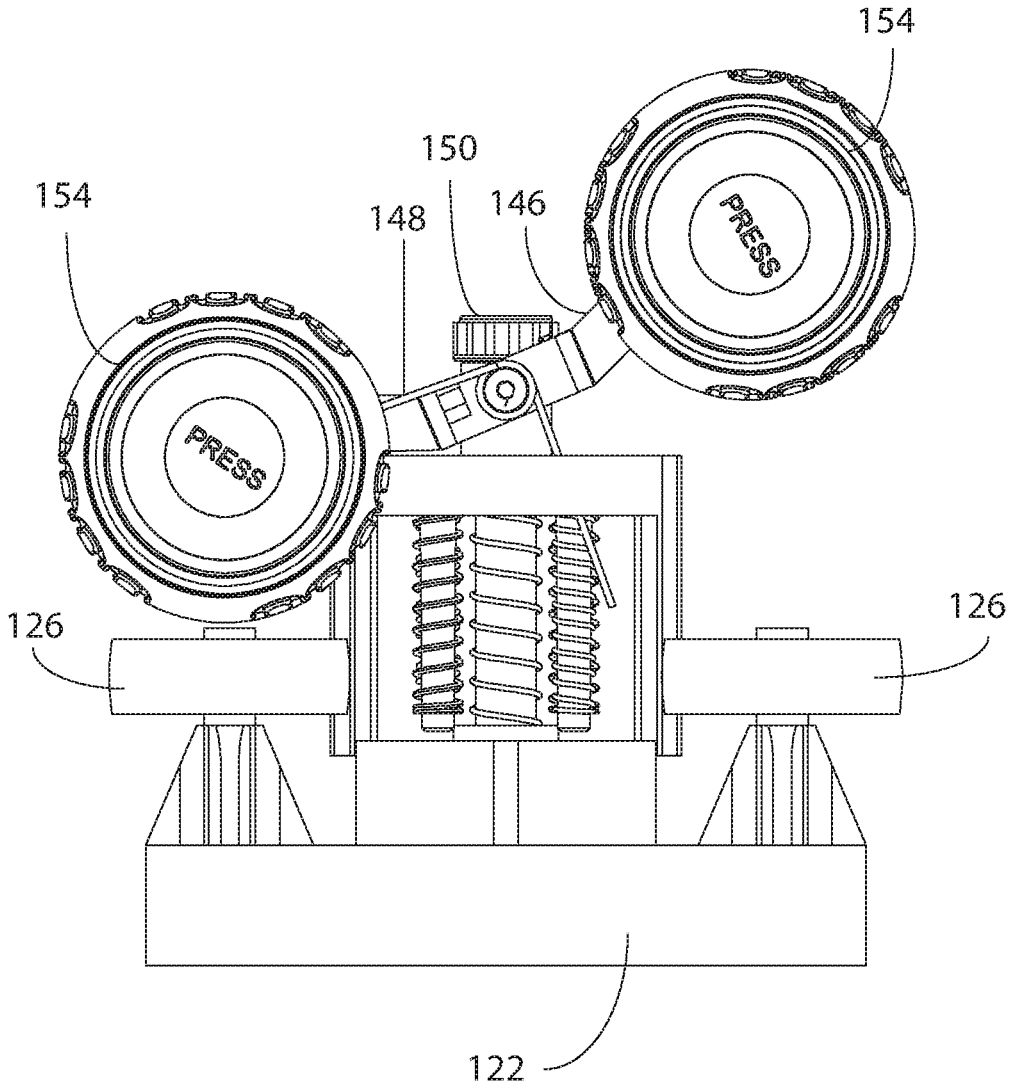
FIG. 12 is a side elevation of the massage head of FIG. 10, articulating to the front.
Figure 13:
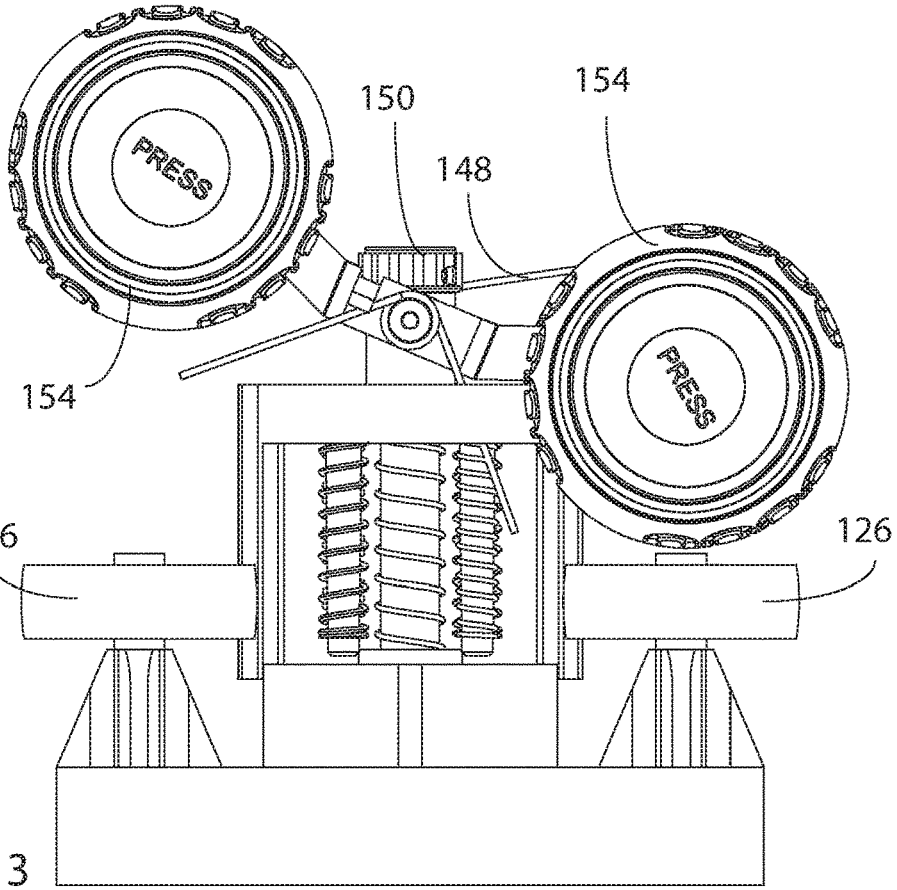
FIG. 13 is a side elevation of the massage head of FIG. 10, articulating to the back.
Figure 14:
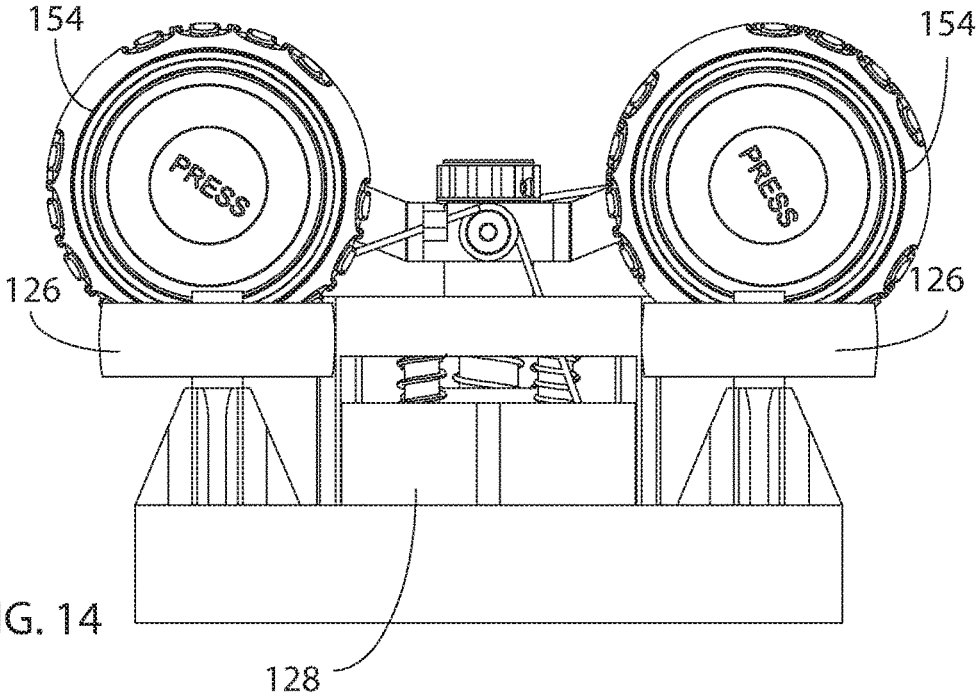
FIG. 14 is a side elevation of the massage head of FIG. 10, compressed.
Figure 15:
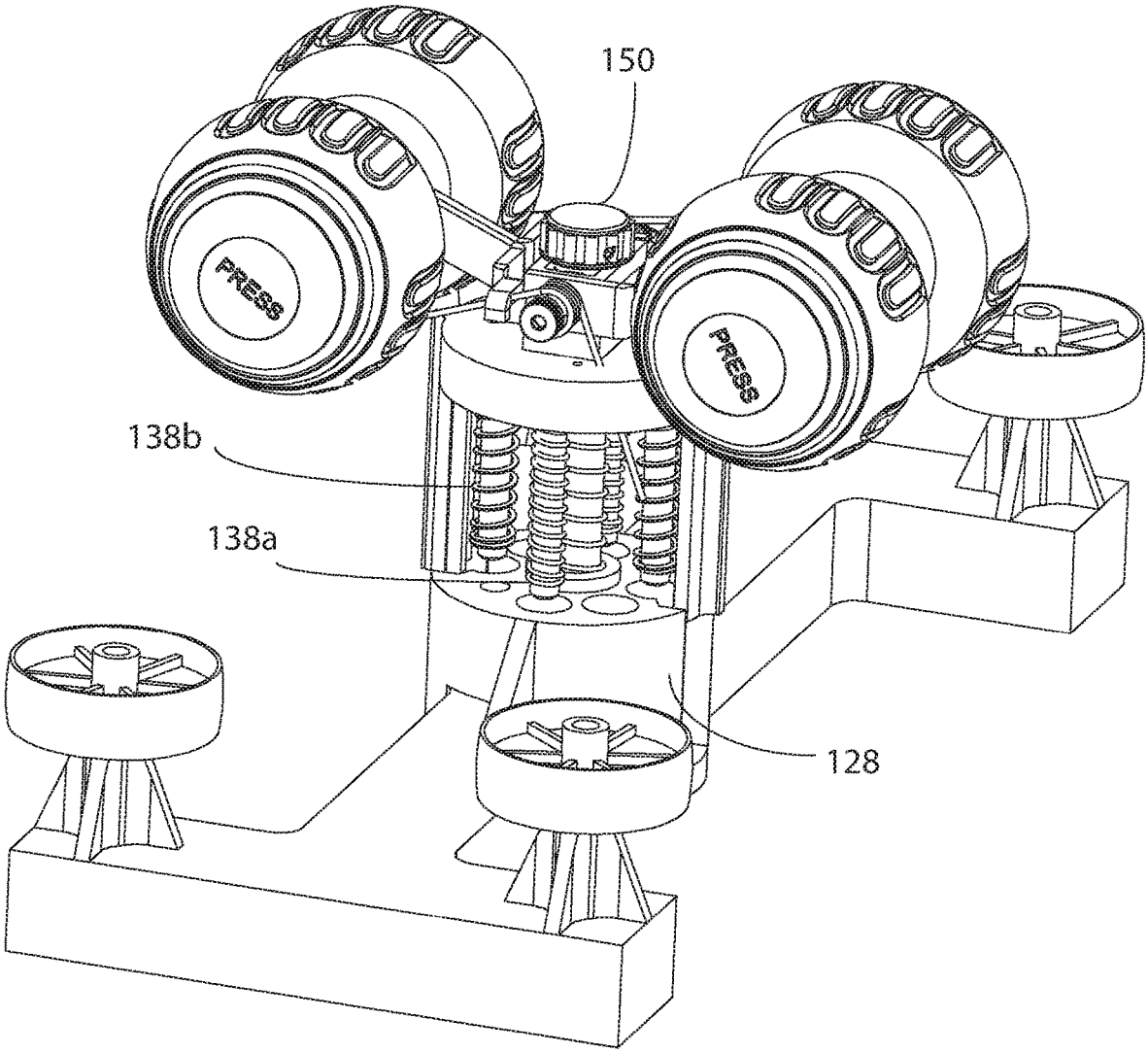
FIG. 15 is an alternate perspective view of the massage head of FIG. 7.
Figure 16:
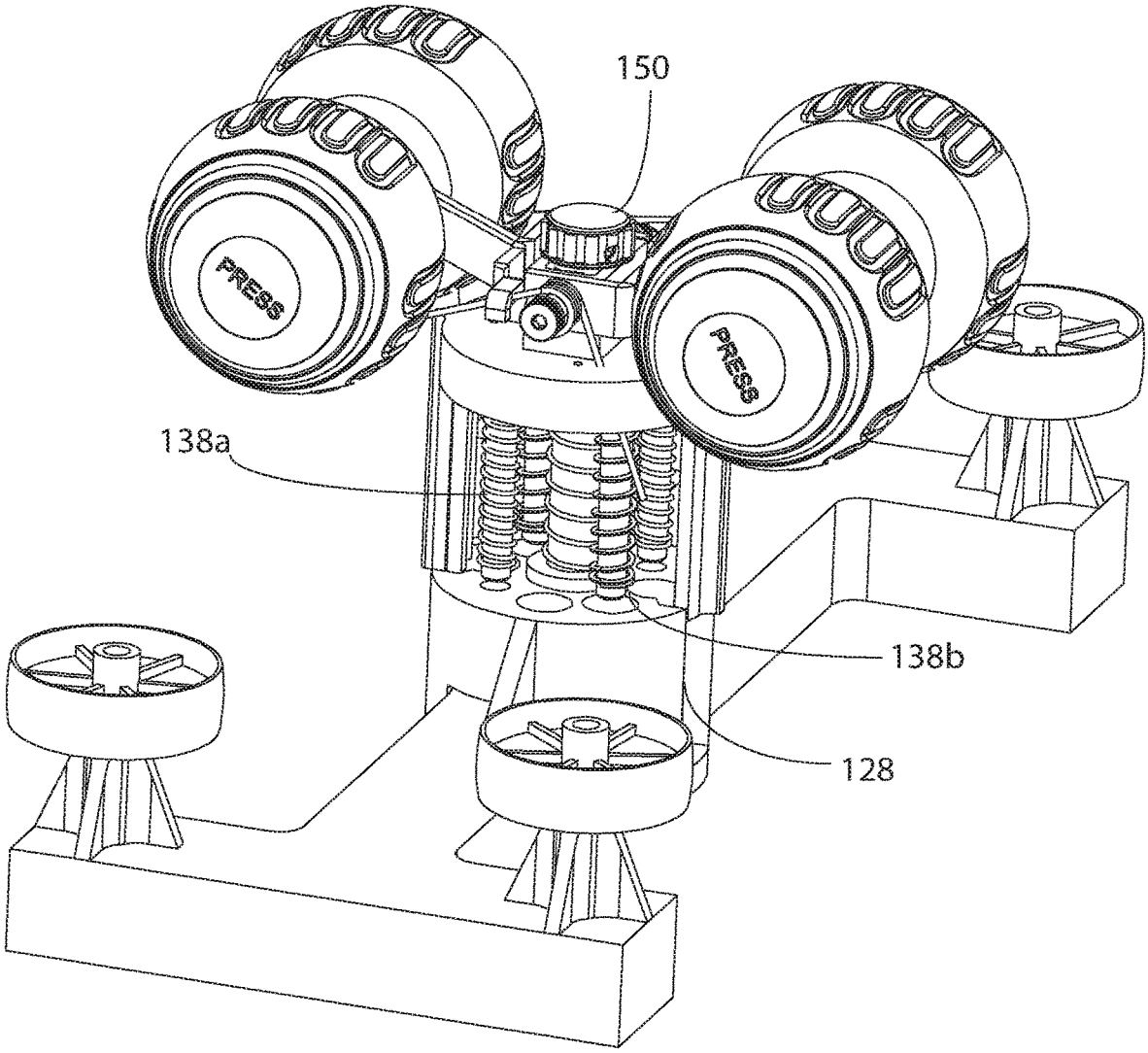
FIG. 16 is the massage head of FIG. 15, adjusted to a tighter compressive spring setting.
Figure 17:
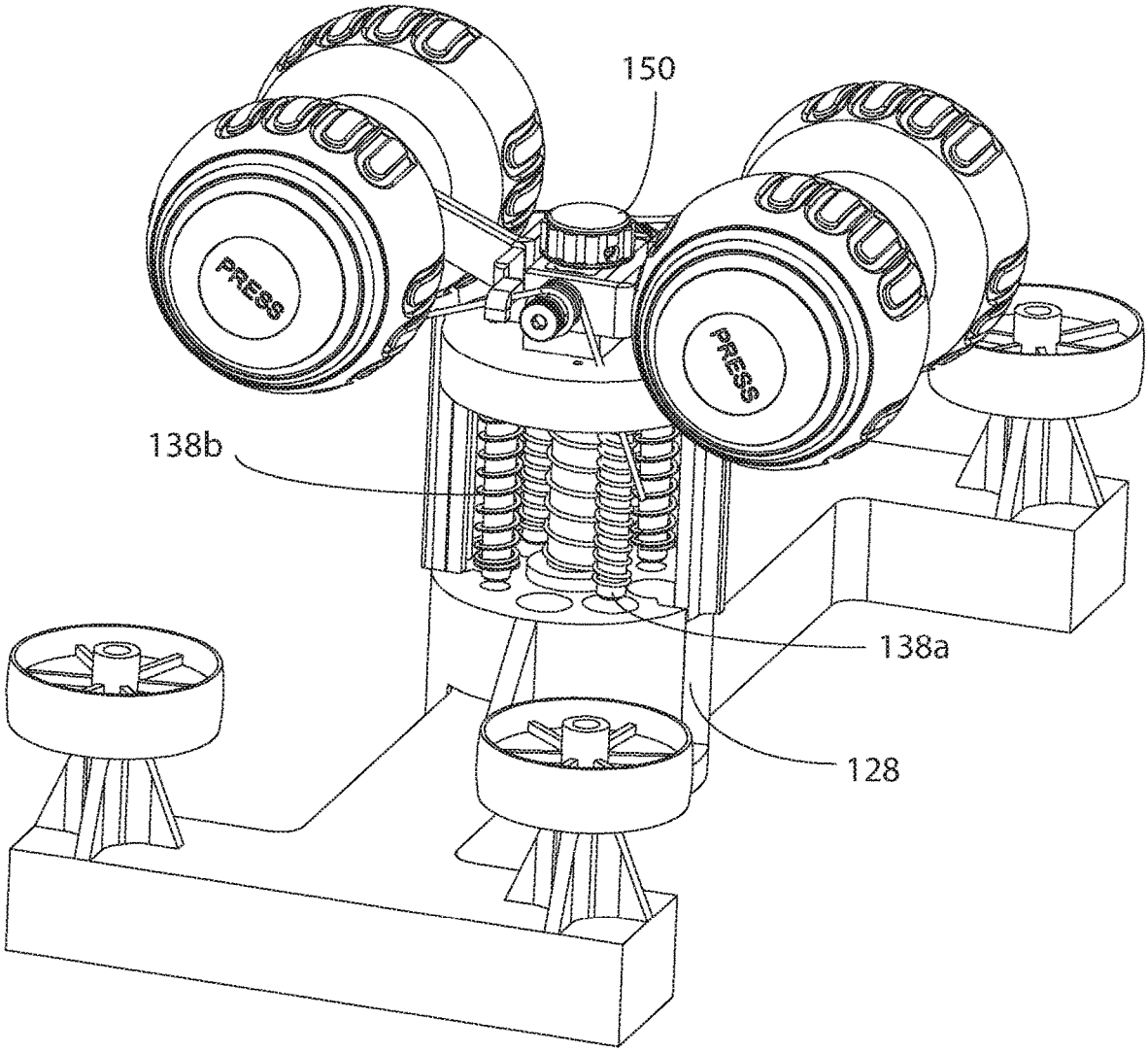
FIG. 17 is the massage head of FIG. 16, adjusted to an even tighter compressive spring setting.

As can be seen in FIGS. 12 and 13, the rockers 146 and torsion springs 148 provide forward and backward articulation of the active portion of the massage head 120. In FIGS. 14-17, compression of this active portion is illustrated. As noted before, downward prongs 142 of the carapace 140 interface with two lateral slots in the housing 128 of the I-shaped base 122. A bore of sufficient width to accommodate one of the carriage's downward prongs and a spring is incorporated with the slots. In this embodiment, two other such bores are associated with each slot and fashioned along the circumference of the housing 128, for a total of six such holes. A smaller bore, sufficient to only receive a downward prong of the carriage 136 follows in succession, for a total of 8 bores, 4 diametrically opposed and one pair with a different size than the others. Carriage 136 is made with four prongs diametrically opposed in pairs. Springs 138*a* and 138*b* are of differing spring constants. When the easiest selection is made (FIG. 15), both pairs of prongs and springs fit within two sets of larger bores. A medium selection (FIG. 16) is made when the selector knob 150 turns the carriage so that the prongs with the lighter spring 138*a* are over the smaller bore while the most resistive setting (FIG. 17) places the heavier spring 138*b* over the smaller hole. In this way the carriage springs will add their resistance to the central spring 134 for greater resistance.

Figure 18:
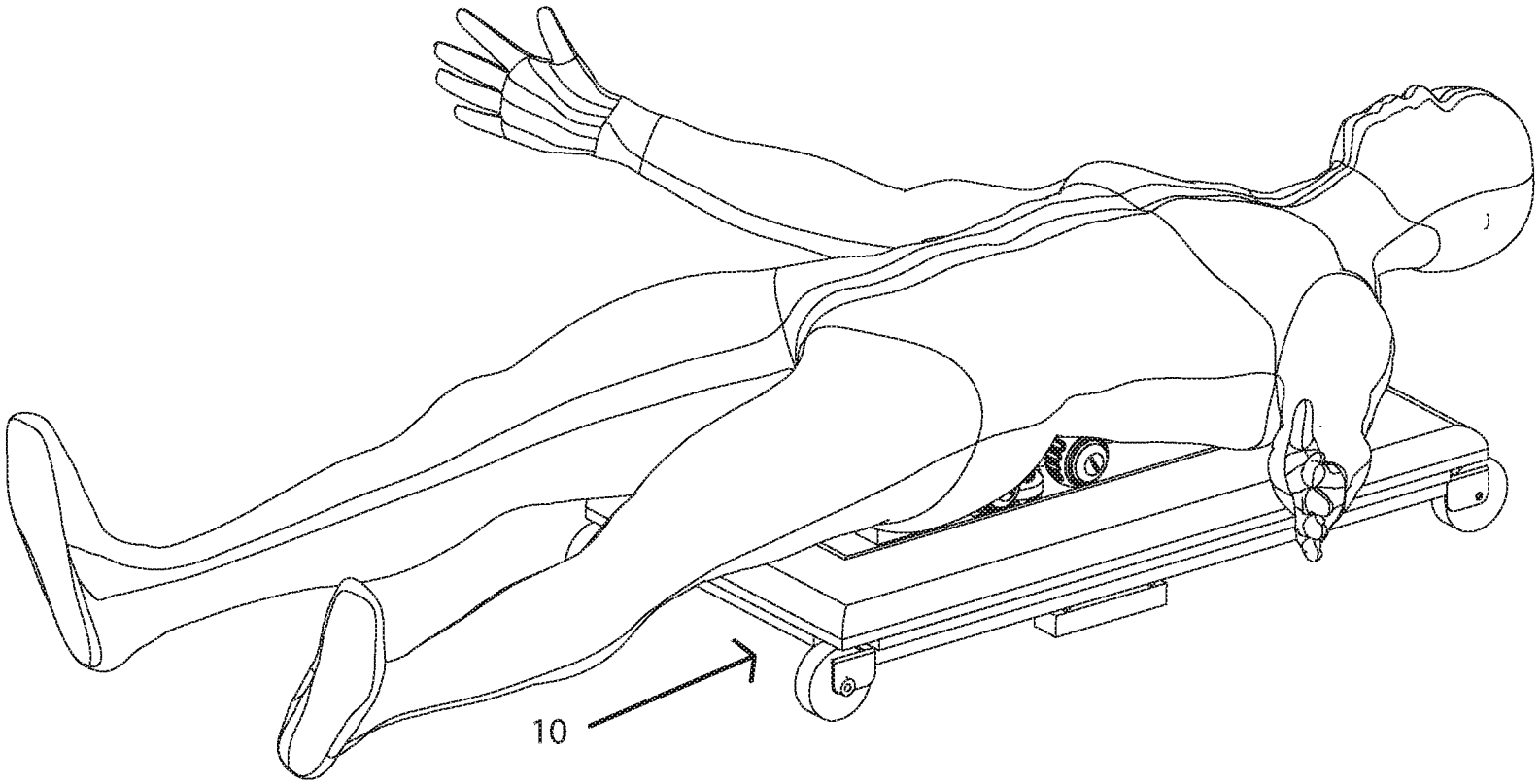
FIG. 18 is a perspective view of the massage table and massage head of FIG. 1, in use.

In use, FIGS. 18 and 19, the user will adjust resistance on the massage head 120 and set it on the ground 5 and place the support table 110 over it. The user will then lie on the support table 110, letting it support the body and keep back muscles flaccid. The user then rolls with the support table 110 while the massage head 120 stays in position.

It should be noted that the roller balls 154 may be replaceable with other massaging structures, such as roller balls of differing hardness or different tools entirely, such as a foam roller.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A massage table comprising:

a support table mounted upon a means for rolling motion, the table having a central slot therethrough; and a massage head, independently movable in relation to the table and having a massaging structure that extends through the central slot of the support table, the massage head further comprising a carapace, on which the massaging structure is mounted, with two downward prongs, a central support pin surrounded by a central spring, and a base with a central housing, the central support pin extending through the central housing and interfacing with the carapace such that the central spring is between the carapace and the base, the housing also having two slots for the downward prongs.

2. The massage table of claim 1, the massaging structure being articulable in a forward and backward motion.

3. The massage table of claim 2, the massaging structure comprising two spring-loaded rockers pivotably mounted on a fulcrum in a mirrored relationship, two axles extending through two ends of the two rockers and two roller balls mounted upon each axle.

4. The massage table of claim 1, the massage head further comprising a fulcrum on the top of the carapace and a knob located on top of the fulcrum while the knob interfaces with the central support pin such that tightening the knob will compress the central spring, thereby allowing the massage head to have having selectable levels of compressibility.

5. The massage table of claim 1, the massage head having a plurality of position wheels which interact with an inner wall about the central slot of the support table so as to maintain in-line positioning of the massage head and support table.

6. A massage table comprising:

a support table mounted upon a means for rolling motion, the table having a central slot therethrough; and a massage head, independently movable in relation to the table and having a massaging structure that extends through the central slot of the support table, the massage head further comprising a carapace, on which the massaging structure is mounted, with two downward carapace prongs over a carriage, said carriage having a plurality of downward carriage prongs, each carriage prong being surrounded by a spring, and a central housing in a base having two receiving slots for the downward carapace prongs and also having a plurality of receiving bores for receiving the plurality of carriage prongs.

7. The massage table of claim 6, the massaging structure being articulable in a forward and backward motion.

8. The massage table of claim 7, the massaging structure comprising two spring-loaded rockers pivotably mounted on a fulcrum in a mirrored relationship, two axles extending through two ends of the two rockers and two roller balls mounted upon each axel.

9. The massage table of claim 6, the massage head having a plurality of position wheels which interact with an inner wall of the central slot of the support table so as to maintain in-line positioning of the massage head and support table.

10. The massage table of claim 6, the massage head further comprising a fulcrum on the top of the carapace and a knob located on top of the fulcrum while interfacing the central support pin such that tightening the knob will compress the central spring, thereby allowing the massage head to have selectable levels of compressibility.

* * * * *